US012588770B2

(12) United States Patent
Bruce, II

(10) Patent No.: US 12,588,770 B2
(45) Date of Patent: Mar. 31, 2026

(54) METHODS AND APPARATUS FOR CUP DISPENSING

(71) Applicant: Lancer Corporation, San Antonio, TX (US)

(72) Inventor: James Elexander Bruce, II, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 194 days.

(21) Appl. No.: 18/391,598

(22) Filed: Dec. 20, 2023

(65) Prior Publication Data

US 2024/0206649 A1 Jun. 27, 2024

Related U.S. Application Data

(60) Provisional application No. 63/434,764, filed on Dec. 22, 2022.

(51) Int. Cl.
*A47F 1/08* (2006.01)
*A47F 5/12* (2006.01)

(52) U.S. Cl.
CPC ..... *A47F 1/085* (2013.01); *A47F 5/12* (2013.01)

(58) Field of Classification Search
CPC ..... G07F 13/10; A47F 1/10; A47F 1/085
USPC ..... 221/123, 1
See application file for complete search history.

(56) References Cited

U.S. PATENT DOCUMENTS 2,919,051 A * 12/1959 Wideburg ..... A47F 1/10 221/243
3,120,324 A * 2/1964 Amberg ..... G07F 13/10 221/241
3,831,807 A * 8/1974 Deaton ..... G07F 11/58 221/85
4,989,753 A * 2/1991 Brogna ..... G07F 13/10 221/121
5,000,345 A * 3/1991 Brogna ..... G07F 13/10 141/141
6,325,243 B1 * 12/2001 Bennett ..... A47F 1/085 221/307
6,357,624 B1 * 3/2002 Brown ..... A47F 1/065 221/280
7,431,176 B2 * 10/2008 Bauman ..... A47F 1/10 221/133
8,561,838 B2 * 10/2013 Jarisch ..... B65G 57/28 221/188
12,252,390 B2 * 3/2025 Dresser ..... G07F 13/10
2004/0000559 A1 * 1/2004 Bauman ..... A47F 1/10 221/133

(Continued)

FOREIGN PATENT DOCUMENTS

WO WO-2007122181 A1 * 11/2007 ..... B25J 9/107
WO WO-2009003036 A1 * 12/2008 ..... G07F 11/22

OTHER PUBLICATIONS

PCT/US2023/085018. International Search Report, Written Opinion of the ISA, and the examiner's search strategy and results.

*Primary Examiner* — Rakesh Kumar
(74) *Attorney, Agent, or Firm* — Christopher L. Makay

(57) ABSTRACT

A cup dispenser (10) and associated methods are provided in which the cup dispenser (10) is tiltable (including rotation) between a dispensing position and a loading position. In the loading position, cups are easily loaded into the cup dispenser (10). A rolling-element bearing (30) may, among other mechanisms, be employed to facilitate the movement.

19 Claims, 5 Drawing Sheets

(56) References Cited

U.S. PATENT DOCUMENTS

| | | | | |
|---|---|---|---|---|
| 2007/0246478 | A1* | 10/2007 | Jarisch | A47J 31/3642 221/123 |
| 2024/0206649 | A1* | 6/2024 | Bruce, II | A47F 5/12 |

* cited by examiner

METHODS AND APPARATUS FOR CUP DISPENSING

CROSS-REFERENCE TO RELATED APPLICATION AND PRIORITY INFORMATION

This application claims the benefit of and priority from prior filed U.S. provisional application No. 63/434,764, entitled "Methods and Apparatus for Cup Dispensing", filed Dec. 22, 2022, which is incorporated herein by reference in its entirety.

TECHNICAL FIELD OF THE INVENTION

This invention relates generally to dispensing, and in particular to cup dispensers and associated methods.

BACKGROUND OF THE INVENTION

In many locations, such as, without limitation, quick service restaurants and convenience stores, beverages are dispensed from beverage dispensers into cups. The beverage dispensers may be operated by—and cups handled by—crew members or self-serve customers. In other instances, a beverage dispenser may automatically handle the cups (for example, an automatic dispenser may automatically dispense a cup and fill it with a beverage).

Cups are often made available from a stack of cups in a cup dispenser, with the bottom, closed end of the bottom cup of the stack presented to the user (or automatic system).

SUMMARY OF THE INVENTION

In accordance with the teachings of the present invention, a cup dispenser and associated method are provided. In a particular embodiment, the cup dispenser comprises a plurality of cup housings each adapted to house a plurality of cups, each cup housing comprising a cup dispensing end and a cup loading end, and a tilting apparatus coupled to the cup housings operable to allow the cup housings to tilt between a cup dispensing position and a cup loading position, wherein in the cup loading position, the cup loading ends of the cup housings are accessible for cup loading. The tilting apparatus may include a coupling member coupled to each of the cup housings.

In one particular embodiment, the tilting apparatus may comprise a rolling-element bearing, and the rolling-element bearing may comprise a face-mount crossed-roller bearing. The tilting apparatus may further comprise a coupling member coupled to each of the cup housings and the rolling-element bearing.

The tilting apparatus may comprise one or more stops adapted to prevent tilting beyond the cup loading position or beyond the cup dispensing position.

In one particular embodiment, the tilting apparatus comprises a member comprising two ends, with one end coupled to the cup housings, and a pivot member coupled to the other end of the member.

The tilting apparatus may also comprise a holster adapted for coupling to a surface, and a pivot adapter adapted for engagement with the holster to couple the cup dispenser to the surface.

The tilting apparatus may also comprise a catch adapted to reduce the likelihood of unintended tilting away from the cup dispensing position.

Also provided is a cup dispenser that comprises a plurality of cup housings each adapted to house a plurality of cups, each cup housing comprising a cup dispensing end and a cup loading end, a coupling member coupled to the cup housings, and a rolling-element bearing coupled to the coupling member operable to allow the cup housings to tilt between a cup dispensing position and a cup loading position, wherein in the cup loading position, the cup loading ends of the cup housings are accessible for cup loading. This cup dispenser may also comprise a first stop adapted to prevent tilting beyond the cup dispensing position, and may also comprise a second stop adapted to prevent tilting beyond the cup loading position. The cup dispenser may also comprise a holster adapted for coupling to a surface and a pivot adapter coupled to the rolling-element bearing and adapted for engagement with the holster. A catch adapted to reduce the likelihood of unintended tilting away from the cup dispensing position may also be included.

Also provided is a method of operating a cup dispenser having a plurality of cup housings each adapted to house a plurality of cups, each cup housing comprising a cup dispensing end and a cup loading end, which comprises tilting the cup housings between a cup dispensing position and a cup loading position, wherein in the cup loading position, the cup loading ends of the cup housings are accessible for cup loading, and in the cup loading position, loading cups into one or more of the cup housings. Tilting may comprise rotation of a rolling-element bearing.

The method may also comprise engaging against one or more stops to prevent tilting beyond the cup loading position or beyond the cup dispensing position.

Tilting may comprise rotation about a pivot.

Important technical advantages are provided by the present invention. In particular, and without limitation, by providing a cup dispenser movable between a dispensing position and a loading position, cup loading is made more efficient, and valuable counter space may be conserved. Furthermore, without the present invention, cup loading may require a user to step on a ladder (or other surface) to load cups, which can be inefficient and dangerous. The present invention allows for moving the cup loading ends of the cup dispenser into a convenient position that allows efficient and safe cup loading.

BRIEF DESCRIPTION OF THE DRAWINGS

Reference is made in the description to the following briefly described drawings, which are not drawn to scale, and in which like reference numerals indicate like features.

DETAILED DESCRIPTION OF THE INVENTION

Figure 1B:
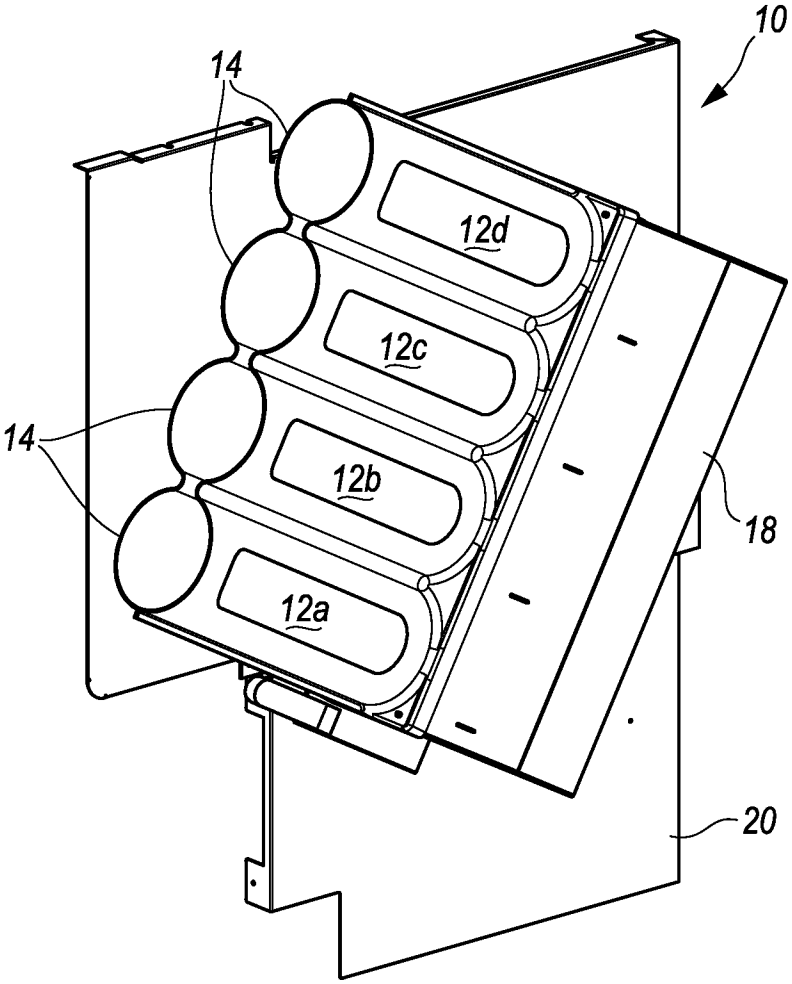
FIGS. 1A and 1B are perspective views of one embodiment of a cup dispenser in, respectively, a cup dispensing position and a cup loading position, according to the teachings of the present invention.
Figure 1A:
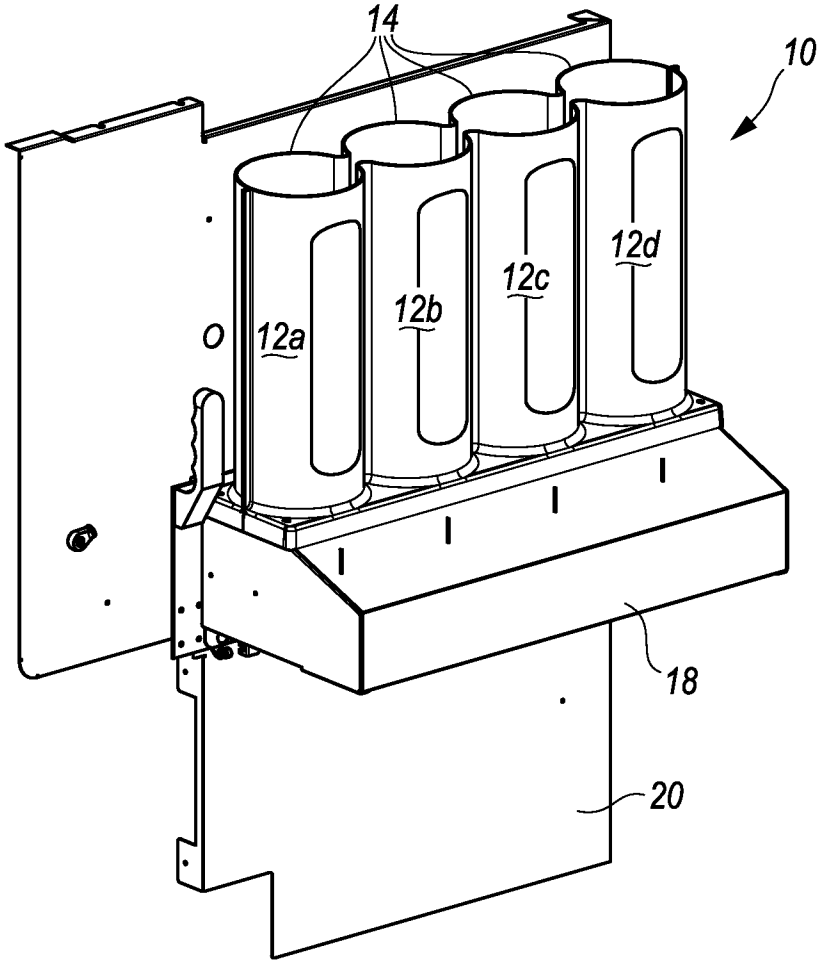

FIGS. 1A and 1B illustrate one embodiment of cup dispenser 10 according to the teachings of the present invention. FIG. 1A shows cup dispenser 10 in a cup dispensing position, and FIG. 1B shows cup dispenser 10 tilted into a cup loading position.

In the illustrated embodiment of FIGS. 1A and 1B, cup dispenser 10 includes four cup housings 12*a*-12*d*. Although four cup housings 12 are shown, fewer or more may be included. Indeed, only one cup housing 12 may be used. Each cup housing 12 has a cup loading end 14 and a cup dispensing end 16 (see also, e.g., FIG. 4).

Furthermore, FIGS. 1A and 1B illustrate an embodiment that includes an automation housing 18, for housing features (not shown) associated with automatic cup handling, for example in an automated beverage dispenser. Cup dispenser 10 is shown mounted on a surface 20, which may be any suitable surface, such as, without limitation, a wall, or a side of a beverage dispenser or other piece of equipment. However, cup dispenser 10 need not be mounted on a surface, and, for example and without limitation, may be integrated with a stand.

In a particular embodiment, the longitudinal axes of the cup housings 12 are aligned substantially in a single plane, although other embodiments may be used, for example, without limitation, with the cup housings 12 staggered or arranged in a turret configuration.

Figure 2:
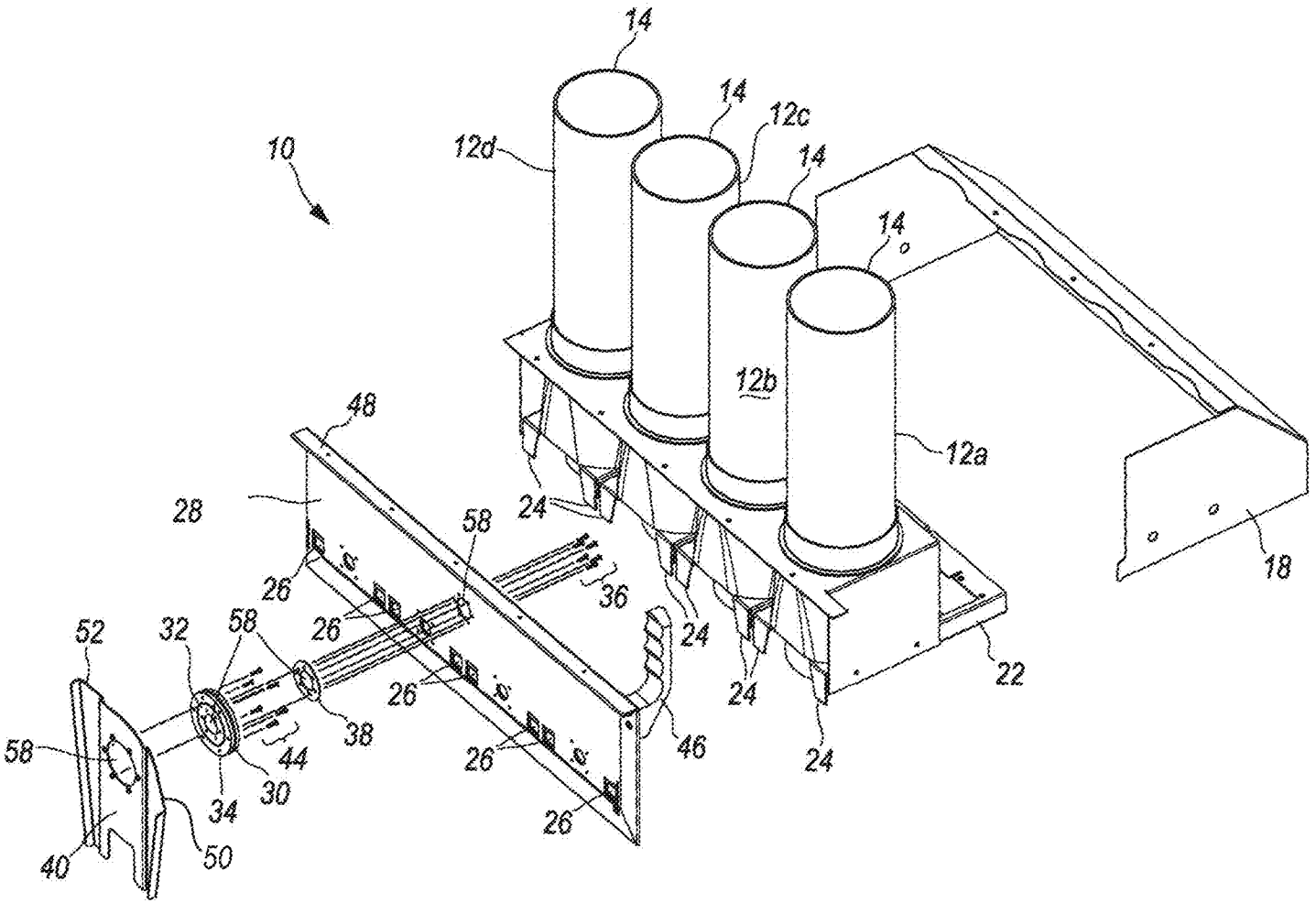
FIG. 2 is a partially exploded perspective view of one embodiment of a cup dispenser according to the teachings of the present invention.

FIGS. 2 (partially exploded view) and 3A illustrate a particular embodiment of a tilting apparatus that allows cup dispenser 10 to tilt, according to the teachings of the present invention. As shown, cup housings 12 are seated in or otherwise coupled to or formed with a cup housing base 22. Base 22 may be one piece accommodating each cup housing 12, or multiple pieces in a modular arrangement (separate base pieces for each cup housing 12). The cup housing base 22 includes brackets 24 which are received in openings 26 of a coupling member 28, although any suitable mechanism may be used to couple coupling member 28 to the base 22 or directly to the cup housings 12.

Figure 3A:
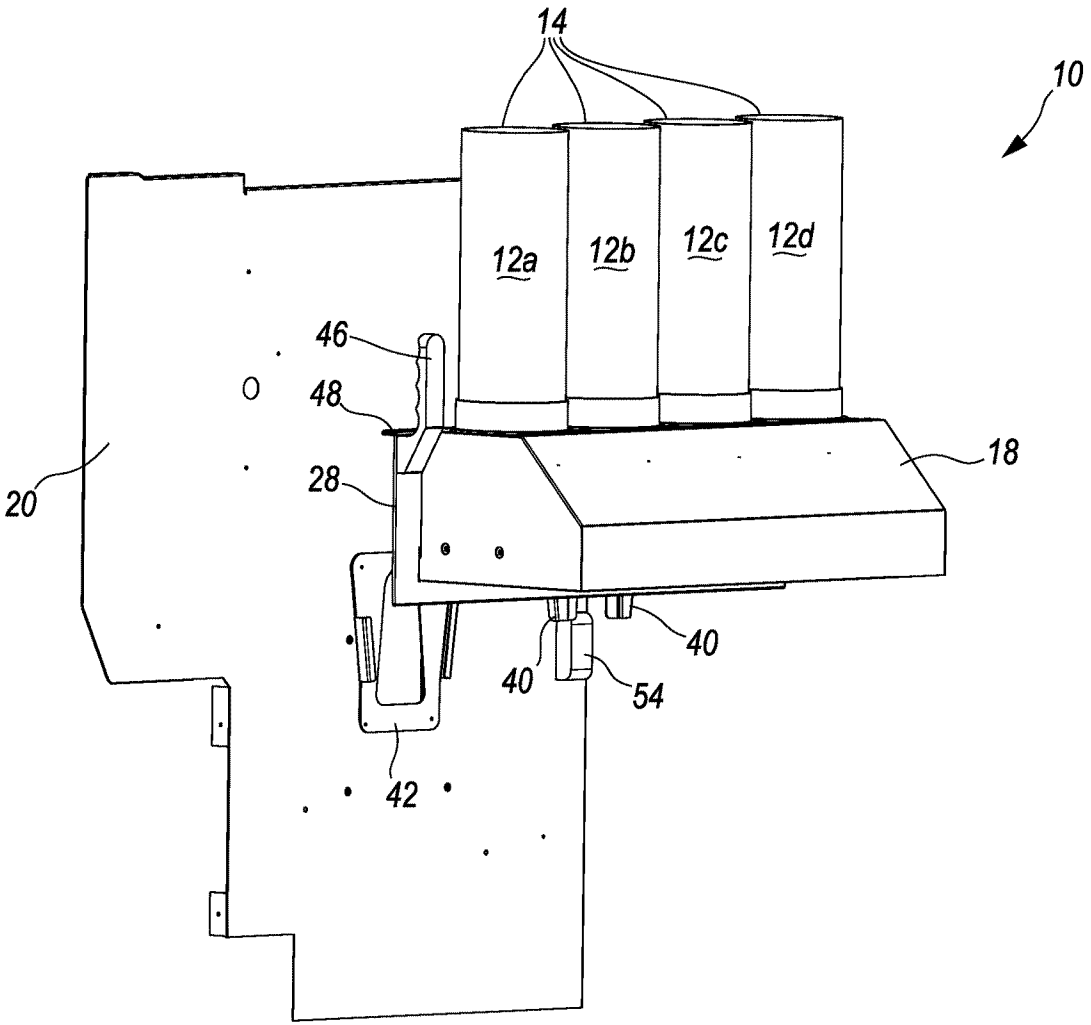
FIGS. 3A and 3B are, respectively, a perspective view and side view of one embodiment of a cup dispenser according to the teachings of the present invention.

Coupling member 28 is coupled to a rolling-element bearing 30, which allows the cup housings 12 to tilt by rotation of the rolling-element bearing 30. Rolling-element bearing 30 includes an inner ring 32 and an outer ring 34 in rotating engagement. In the illustrated embodiment, inner ring 32 is coupled (for example, without limitation, with screws 36) to coupling member 28, optionally through a spacer 38. Outer ring 34 is coupled to any suitable surface 20, optionally through a pivot adaptor 40 which engages with a holster 42. Without limitation, screws 44 may be used to couple outer ring 34 to adaptor 40. As shown in FIG. 3A, holster 42 is suitably coupled to surface 20 (for example, without limitation, by welding or screws). FIG. 3A shows the cup dispenser 10 with the pivot adapter 40 disengaged from the holster 42.

Figure 3B:
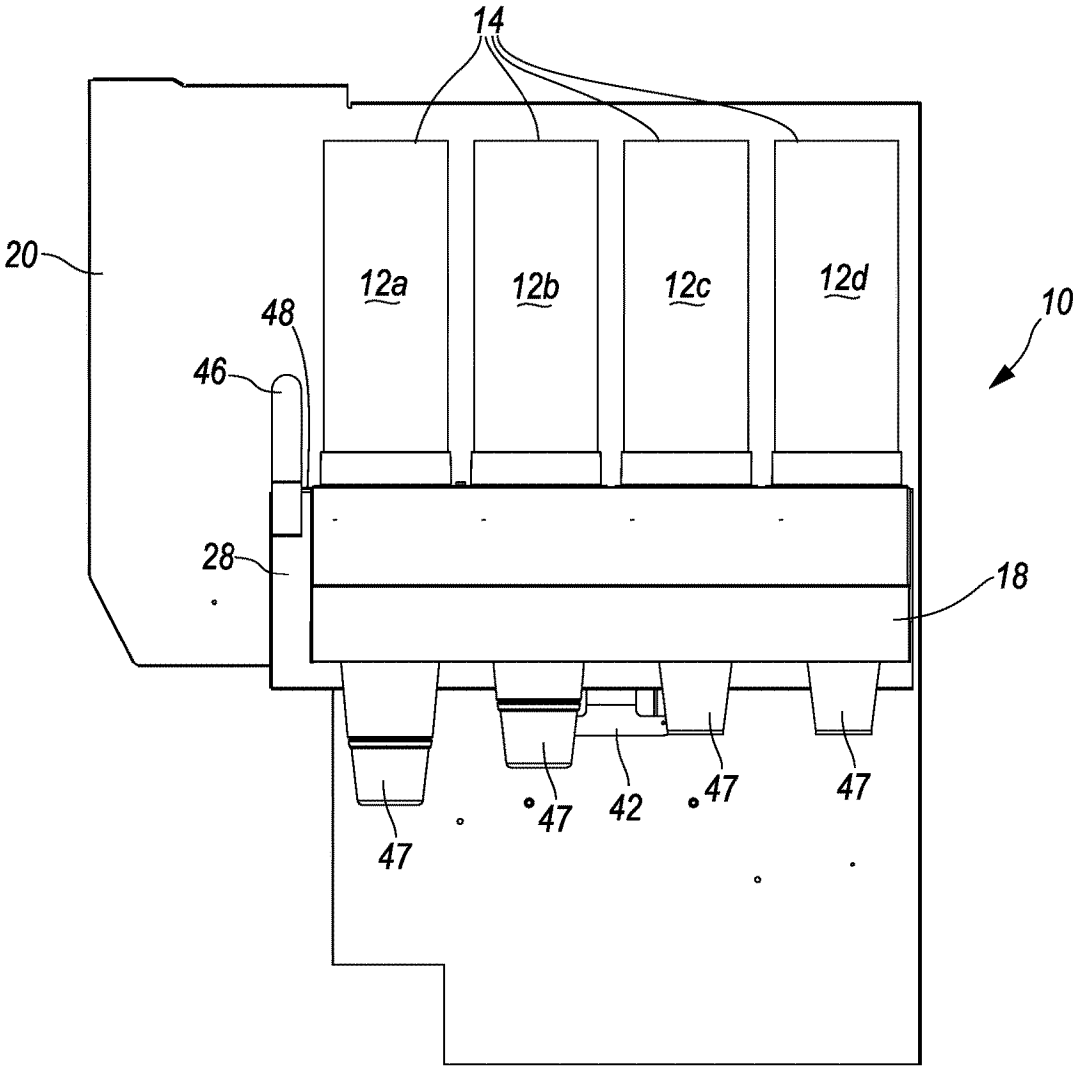

In operation of this embodiment, coupling member 28 and cup housings 12 tilt via rotation of inner ring 32 in relation to outer ring 34, with outer ring 34 stationary with respect to the surface 20. A handle 46 may be provided to facilitate tilting of the cup dispenser 10. FIG. 3B is a side view of the cup dispenser of FIG. 3B (for reference, the handle 46 is in the front). FIG. 3B shows an example of cups 47, which emerge from the dispensing ends 16 of the cup housings 12. The cups may vary in size from cup housing to cup housing, or some cup housings may house the same size cups as housed in other cup housings.

The extent of rotation of the cup dispenser 10 may be limited in any suitable way. In the illustrated embodiment, coupling member 28 includes a lip 48, and pivot adapter 40 includes stop edges 50 and 52. Rotation beyond the cup loading position is limited by the contact of lip 48 with stop edge 50, which is angled as desired for the cup loading position (for example, and without limitation, in the range of 30□ to 60□ from horizontal). Rotation beyond the cup dispensing position is limited by the contact of lip 48 with stop edge 52. Stop edge 52 is generally horizontal, although it can be at any suitable angle.

Also, a friction catch 54 (or other suitable device) may be coupled to surface 20 for contact with coupling member 28 to reduce the likelihood of unintended tilting away from the cup dispensing position. A catch may also be used to reduce the likelihood of unintended tilting away from the cup loading position. Indeed, any suitable latch, lock, catch, magnet, spring-loaded ball and receiving socket, or other suitable device (any such device referred to herein as a catch) may be used to reduce the likelihood of undesired movement out of either or both of the cup dispensing or cup loading positions.

In a particular embodiment, rolling-element bearing 30 is a face-mount crossed-roller bearing from McMaster-Carr® (McMaster-Carr is registered trademark of the McMaster-Carr Supply Company).

Figure 4:
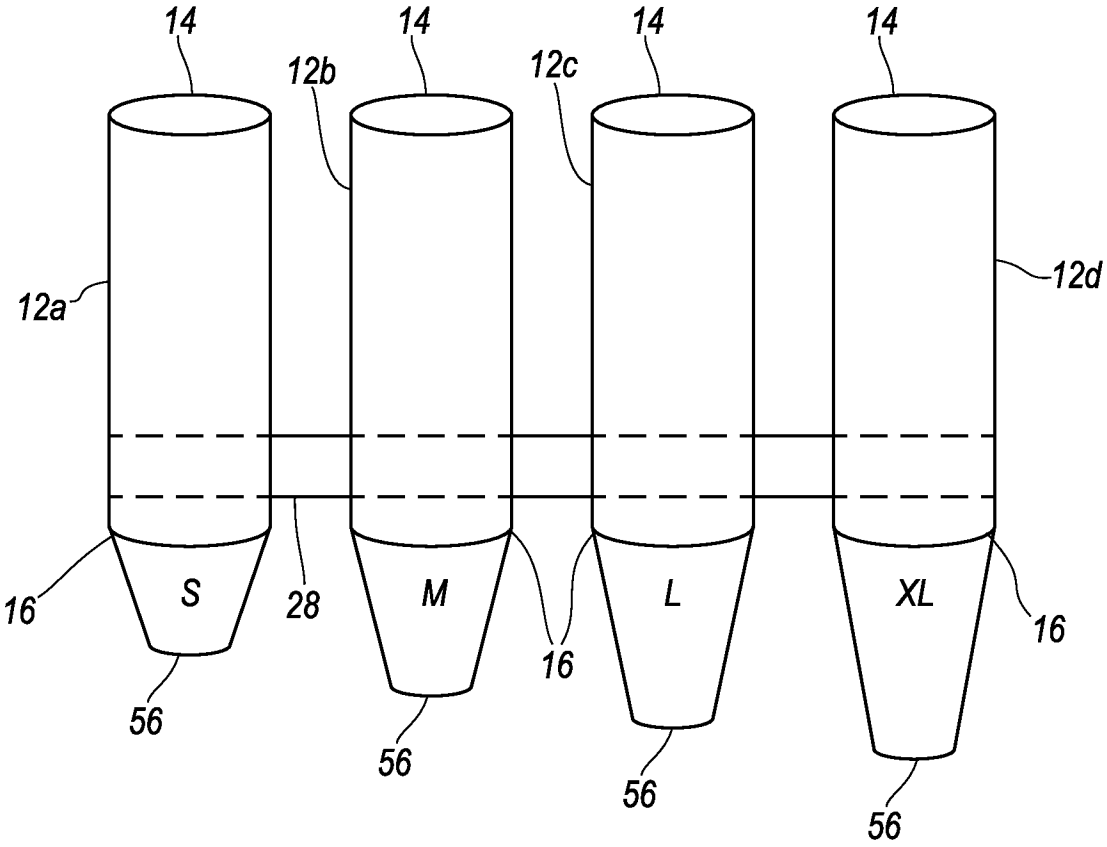
FIG. 4 illustrates another embodiment of cup dispenser housings and a coupling member according to the teachings of the present invention.

The particular components shown in FIGS. 2 and 3 are for one particular embodiment, but other suitable mechanisms may be used. For example, and without limitation, as shown in FIG. 4, cup housing base 22 may be eliminated, and coupling member 28 may be coupled directly, or though other components, to the cup housings 12 (other tilting apparatus components not shown). Furthermore, and without limitation, coupling member 28 may be any suitable member, with any suitable shape. FIG. 4 also shows an example of cups 56 at the dispensing ends 16 of cup housings 12.

Besides a rolling-element bearing, any suitable mechanism may be used in the tilting apparatus to facilitate tilting of the cup housings 12. For example, and without limitation, a member, such as a beam or lever, coupled to a pivot at one of its ends, and to the cup housings 12 (directly or through other coupling members) at the other end, may be used.

Furthermore, tilting may be accomplished manually, or automatically with any suitable drive mechanism.

As shown in FIG. 2, a passageway 58 may be provided through various components to accommodate cables for electrical needs (for example, and without limitation, for automatic cup handling system power and control).

In operation, a user tilts (manually or automatically) the cup dispenser 10 from the cup dispensing position to the cup loading position. In the cup loading position, the cup loading end 14 of each cup housing 12 is presented closer to the user and is easily accessible for loading cups (which normally come in stacks). After loading, the cup dispenser 10 is tilted back to its cup dispensing position.

In many instances, counter space is limited, and the present invention allows for a cup dispenser to be located in positions that help maximize counter space. In one configuration, the cup dispenser 10 is mounted on the side of a beverage dispenser or other surface, with the longitudinal axes of the cup housings 12 aligned substantially in a plane that is substantially perpendicular to the front edge of the counter. In this configuration, the cup dispenser 10 may be tilted toward the front of the counter for easy cup loading, then tilted back to the cup dispensing position.

Also, without the present invention, cup loading may require a user to step on a ladder (or other surface) to reach the cup loading ends 14 for loading cups, which can be inefficient and dangerous. The present invention allows for moving the cup loading ends 14 into a convenient position that allows efficient and safe cup loading.

As used herein, coupled or coupling includes direct connection or indirect connection through one or more intermediate members.

Particular features of the example embodiments may be used with, added to, or substituted in the other example embodiments.

Although the present invention has been described in detail, it should be understood that various changes, alterations, substitutions, additions, and modifications could be made without departing from the intended scope of the invention, as defined in the following claims.

What is claimed is:

1. A method of operating a cup dispenser having a plurality of cup housings each adapted to house a plurality of cups, each cup housing comprising a cup dispensing end and a cup loading end, the method comprising:

providing a tilting apparatus comprising an inner ring and an outer ring in rotating engagement, whereby the outer ring is coupled to a surface and the inner ring is coupled to the cup housings;

rotating the tilting apparatus whereby the inner ring rotates in relation to the outer ring while the outer ring remains stationary with respect to the surface, thereby tilting the cup housings between a cup dispensing position and a cup loading position, wherein in the cup loading position, the cup loading ends of the cup housings are accessible for cup loading; and in the cup loading position, loading cups into one or more of the cup housings.

2. The method of claim 1, wherein tilting comprises rotation of a rolling-element bearing comprised of the inner ring and the outer ring.

3. The method of claim 1, and further comprising engaging against a stop in the cup dispensing position to prevent tilting beyond the cup dispensing position.

4. The method of claim 1, and further comprising:

engaging against a first stop edge in the cup loading position to prevent tilting beyond the cup loading position; and engaging against a second stop edge in the cup dispensing position to prevent tilting beyond the cup dispensing position.

5. The method of claim 1, wherein tilting comprises rotation about a pivot.

6. A cup dispenser, comprising:

a plurality of cup housings each adapted to house a plurality of cups, each cup housing comprising a cup dispensing end and a cup loading end; and a tilting apparatus comprising an inner ring and an outer ring in rotating engagement, whereby the outer ring is coupled to a surface and the inner ring is coupled to the cup housings such that rotation of the inner ring in relation to the outer ring, with the outer ring stationary with respect to the surface, allows the cup housings to tilt between a cup dispensing position and a cup loading position;

wherein in the cup loading position, the cup loading ends of the cup housings are accessible for cup loading.

7. The cup dispenser of claim 6, wherein the tilting apparatus comprises a stop edge adapted to prevent tilting beyond the cup dispensing position.

8. The cup dispenser of claim 6, wherein the tilting apparatus comprises a stop edge adapted to prevent tilting beyond the cup loading position.

9. The cup dispenser of claim 6, wherein the tilting apparatus comprises a rolling-element bearing comprised of the inner ring and the outer ring.

10. The cup dispenser of claim 9, wherein the rolling-element bearing comprises a face-mount crossed-roller bearing.

11. The cup dispenser of claim 9, wherein the tilting apparatus further comprises a coupling member coupled to the rolling-element bearing and to each of the cup housings.

12. The cup dispenser of claim 6, wherein the tilting apparatus comprises a catch adapted to reduce the likelihood of unintended tilting away from the cup dispensing position.

13. The cup dispenser of claim 6, wherein the tilting apparatus comprises a coupling member coupled to the inner ring and to each of the cup housings.

14. The cup dispenser of claim 13, wherein the tilting apparatus comprises a holster adapted for coupling to the surface, and a pivot adapter coupled to the outer ring whereby the pivot adapter is adapted for engagement with the holster to couple the cup dispenser to the surface.

15. A cup dispenser, comprising:

a plurality of cup housings each adapted to house a plurality of cups, each cup housing comprising a cup dispensing end and a cup loading end;

a coupling member coupled to the cup housings; and a rolling-element bearing comprising an inner ring and an outer ring in rotating engagement, whereby the outer ring is coupled to a surface and the inner ring is coupled to the coupling member such that rotation of the inner ring in relation to the outer ring, with the outer ring stationary with respect to the surface, allows the cup housings to tilt between a cup dispensing position and a cup loading position;

wherein in the cup loading position, the cup loading ends of the cup housings are accessible for cup loading.

16. The cup dispenser of claim 15, and further comprising a first stop edge adapted to prevent tilting beyond the cup dispensing position.

17. The cup dispenser of claim 16, and further comprising a second stop edge adapted to prevent tilting beyond the cup loading position.

18. The cup dispenser of claim 15, and further comprising:

a holster adapted for coupling to the surface; and a pivot adapter coupled to the rolling-element bearing and adapted for engagement with the holster.

19. The cup dispenser of claim 15, and further comprising a catch adapted to reduce the likelihood of unintended tilting away from the cup dispensing position.

* * * * *